United States Patent [19]

Coffey

[11] Patent Number: 4,657,004

[45] Date of Patent: Apr. 14, 1987

[54] MOBILE LIVESTOCK INTENSIVE CARE UNIT

[76] Inventor: Robert T. Coffey, R.R. 1, Box 238A, Newton, Iowa 50208

[21] Appl. No.: 901,812

[22] Filed: Aug. 29, 1986

[51] Int. Cl.[4] ..... A61D 7/00

[52] U.S. Cl. ..... 128/134; 128/205.23; 128/204.18; 604/114; 604/259; 119/103

[58] Field of Search ..... 128/134, 204.18, 200.24, 128/202.13, 202.16, 205.26, 205.23, 1 B, 204.17; 604/80, 81, 257, 259, 251, 113, 114; 119/98, 99, 103

[56] References Cited

U.S. PATENT DOCUMENTS

| | | | |
|---|---|---|---|
| 1,714,635 | 5/1929 | Schafer | 119/98 |
| 2,700,384 | 1/1955 | Ivory | 128/205.26 |
| 3,464,388 | 9/1969 | Stout | 119/15 |
| 4,055,148 | 10/1977 | Brockman et al. | 119/103 |
| 4,171,683 | 10/1979 | Godin | 119/15 |
| 4,343,304 | 8/1982 | Hickmann | 119/15 |
| 4,464,563 | 8/1984 | Jewett | 604/114 |
| 4,501,275 | 2/1985 | Maahs | 128/402 |
| 4,509,461 | 4/1985 | Peck | 119/103 |
| 4,526,133 | 7/1985 | LoMaglio | 119/15 |

FOREIGN PATENT DOCUMENTS

| | | | |
|---|---|---|---|
| 10804 | of 1908 | United Kingdom | 119/103 |

*Primary Examiner*—Henry J. Recla
*Attorney, Agent, or Firm*—James D. Birkenholz

[57] ABSTRACT

A mobile livestock intensive care unit for providing intensive medical care to animals. The Unit provides administration of controlled temperature intravenous and subcutaneous fluids and medicines with external heat to the animal and the monitoring of specific bodily functions. The unit includes a restraining area for housing the animal with folding sides to permit access to the animal. The front of the unit is supported by two wheels with the rear being supported by two legs. Handles extend above the legs to permit the rear of the unit to be lifted and moved about on wheels to a desired location. A control cabinet is positioned above the restraining area and includes a temperature controlled fluid/medication chamber for the storing and administration of temperture controlled fluids and medications. A control chamber, adjacent the fluid/medication chamber, controls and monitors the operation of the unit and houses necessary bodily functioning monitoring equipment. Heat is provided to the fluid chamber by a conventional heating element and heat is provided to the restraining area by a controllable heat pad on the floor of the unit. The restraining unit generally is contructed of air-pervious which permits the free exchange of natural environment air through the unit.

8 Claims, 6 Drawing Figures

MOBILE LIVESTOCK INTENSIVE CARE UNIT

BACKGROUND OF THE INVENTION

1. FIELD OF THE INVENTION

The present invention relates to equipment used in the veterinary field for the treatment of animals. More particularly, this invention relates to a mobile intensive care unit for providing medical treatment to animals wherein the animal is maintained and confined to the restraining unit during treatment and temperature controlled fluids and medication are administered to the animal while monitoring specific bodily functions.

2. DESCRIPTION OF THE PRIOR ART

In the veterinary medicine practice, often times medical treatment of animals is necessary in an environment other than a fully equiped veterinary hospital or clinic. The environment may often be an animal shed or a livestock lot. In these environments, it is practically impossible to restrain the animal without subjecting it to more psychological and/or physiological trauma. Further, a work area which would be antiseptic with some degree of environmental temperature control would be all but impossible. During treatment of the animal, often large volumes of intravenous and subcutaneous fluid and/or medications, over a prolonged period of time, must be administered. These fluids and medications generally must be administered at or near the body temperature of the animal and in some instances specifically above or below the bodily temperature. Further, during treatment, it is often necessary to monitor several bodily functions of the animal and to provide oxygen therapy. Thus, without the availability to provide the above specified medical treatment when the need arises, the degree of medical care and treatment is significantly impaired. The prior art illustrates various holding cages for equipment utilized in a clinic capable of meeting some of the aforesaid needs, however, in the field when on-hand treatment may save the animal, a portable unit for restraining the animal without undue trauma and providing the necessary medical facilities and equipment is seriously needed.

SUMMARY OF THE INVENTION

In accordance with the present invention, there is provided a mobile livestock intensive care unit having a restraining unit in which the animal is placed. The restraining unit includes two vertical side walls and two vertical end walls engaging each other with a floor on the bottom portion of the walls. Wheels are mounted on the front of the unit parallel to each other and legs extend downward from the floor near the rear of the unit. Handles extend outward above the legs to permit picking up the rear of the unit and moving the unit to a desired location. One of the walls between the front and rear of the unit is attached to the floor by hinges and releaseably attached at the top of the end walls by pins to permit the wall to be folded downward to a horizontal position. Attached to the folding wall are two legs which rotate downward as the wall is rotated outward from the unit which stabilize the wall when it is in a horizontal position. The wall further include restraint apetures through which a rope may extend into the restraining unit to physically constrain the animal. A portion of the front side wall forms a door and is rotatedly attached at its top by pins and hinges at the bottom to the unit to permit the door to rotate outward and downward to a horizontal position, permitting entrance to the interior front portion of the unit. External legs positioned below the unit provide additional stability. A control cabinet is positioned above the restraining unit and includes a temperature controlled medication/fluid chamber and a control chamber. The medication/fluid chamber generally is rectangular in shape with a door through which visual observation and entrance to the interior of the chamber may be obtained. The medication/fluid chamber is adapted to hold through conventional means intravenous fluids and medications during storage and usage and the internal temperature is controlled through a conventional electrical heating device. The control chamber provides monitoring the temperature in the medication/fluid chamber and activation of heating pad placed on the floor of the restraining unit. Further the control chamber provides visual indication of when oxygen is being administered to the animal and a source of external electrical energy. Further the control chamber provides storage for equipment monitoring various bodily functions of the animal.

DESCRIPTION OF THE PREFERRED EMBODIMENT

Figure 1:
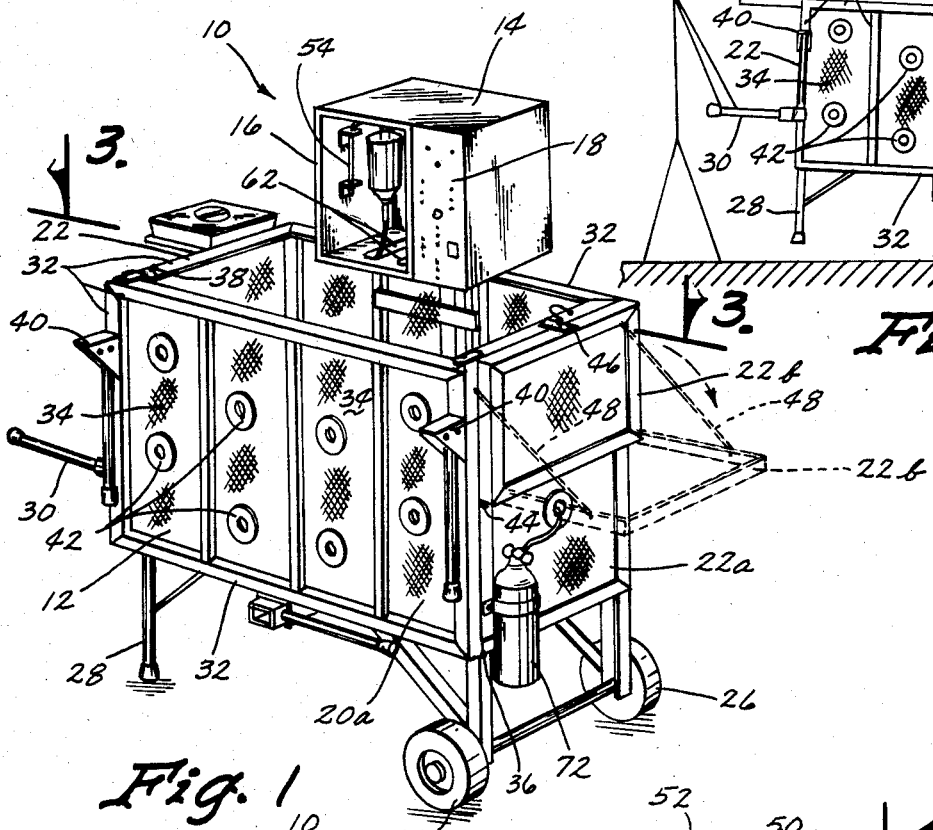
FIG. 1 is an evelated prospective view of the mobile livestock intensive care unit of this invention.

Referring now to the drawings wherein like reference numerals designate identical or corresponding parts throughout the several views wherein a mobile livestock intensive care unit is illustrated at 10 in FIG. 1. The intensive care unit includes generally a restraining unit 12, a control cabinet 14 adjacent the restraining unit 12 which includes a fluid/medication chamber 16 and a control chamber 18.

Figure 2:
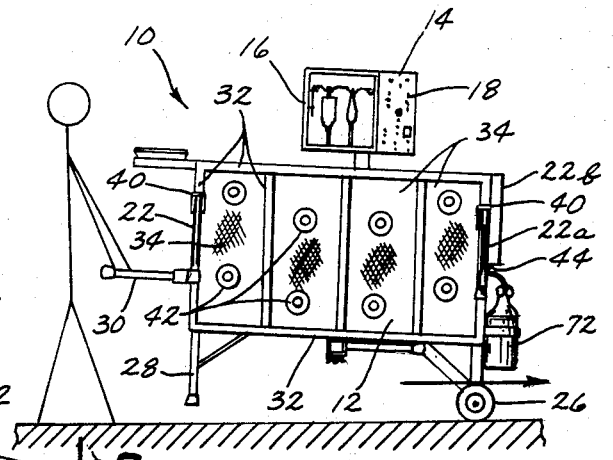
FIG. 2 is a side view of the unit in the process of being moved to a different location.

Specifically, the restraining unit 12 (FIGS. 1–6) includes two vertical side walls 20 and two vertical end walls 22, with the walls 20 and 22 at right angles to each other and engaging each other. A floor 24 engages the bottom portion of the walls 20 and 22 and wheels 26 are mounted beneath the floor 24 on the front of the unit 12 and legs 28 extend downward from the floor 24 at the rear of the unit 12. Handles 30 extend outward from the end wall 22 above the legs 28 to permit the complete unit 10 to be picked up and moved as illustrated in FIG. 2. The walls 20 and 22 and floor 24 are constructed of material which will provide the necessary structural strength to support an animal and at the same time, permitting free exchange of ambient air through the restraining unit 12. In the present embodiment, a frame 32 covered with expanded non-corrosive metal sheets 34 is illustrated. However, perforated fiberglass sheets may also be utilized for the sheets 34. One of the walls 20, particularly **20*a*, is attached to the floor 24 by hinges 36 (FIG. 4) at its bottom and attached to the end walls 22 by a pin 38 (FIGS. 1, 2–4) at its top, whereby the wall 20*a* may fold out from the unit 12 to a horizontal position. Legs 40, attached to the walls 20***a*, rotate downward to contact the ground as the wall 20*a* is opened and support the wall 20*a* in its horizontal position. Restraint apertures 42 extend through the wall 20*a* and permit ropes to pass therethrough to adequately restrain an animal in a recumbent position when necessary.

The front end wall 22, particularly 22*a*, includes a door 22*b* which is rotatably attached by hinges 44 to the remaining portion of the wall 22*a* and releaseably attached by pins 46 (FIGS. 1, 3 and 4) at the top of the unit 12, whereby the door 22*b* may open from the top outward in the same manner as the wall 22*a*. The door 22*b* is held in a horizontal position by straps 48. Separate legs 51 extend underneath the restraining unit 12 and are used where additional support is necessary and to stablize the unit 10. The legs 51 are merely turned downward and contact the ground surface to provide additional stabilization.

Figure 3:
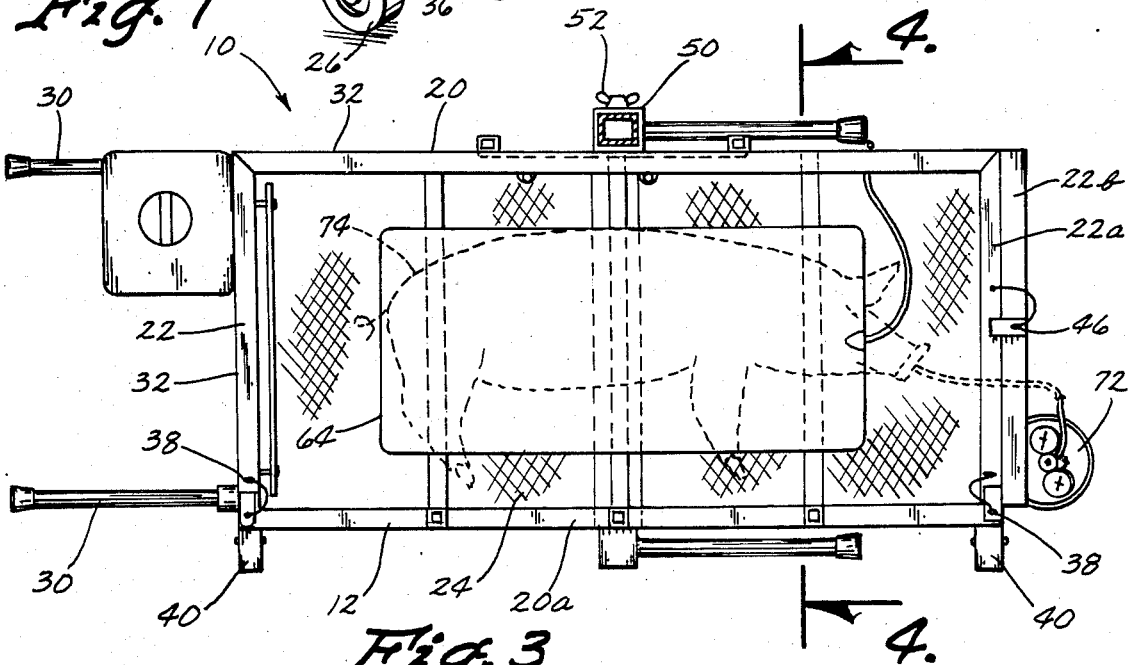
FIG. 3 is a cross-sectional view taken along lines 3—3 of FIG. 1.
Figure 6:
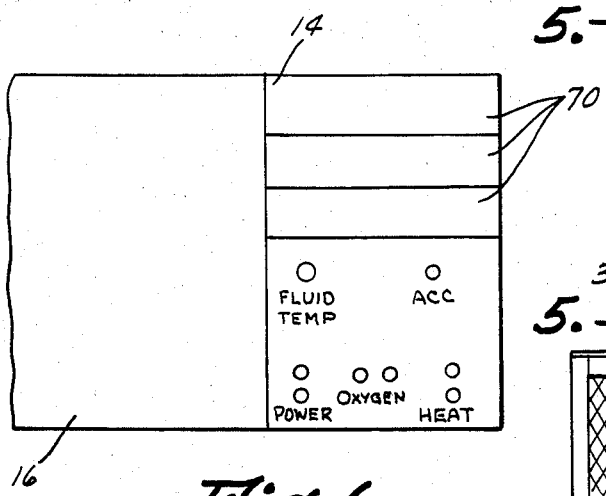
FIG. 6 is a front view of the control cabinet with bodily function monitors in place.
Figure 4:
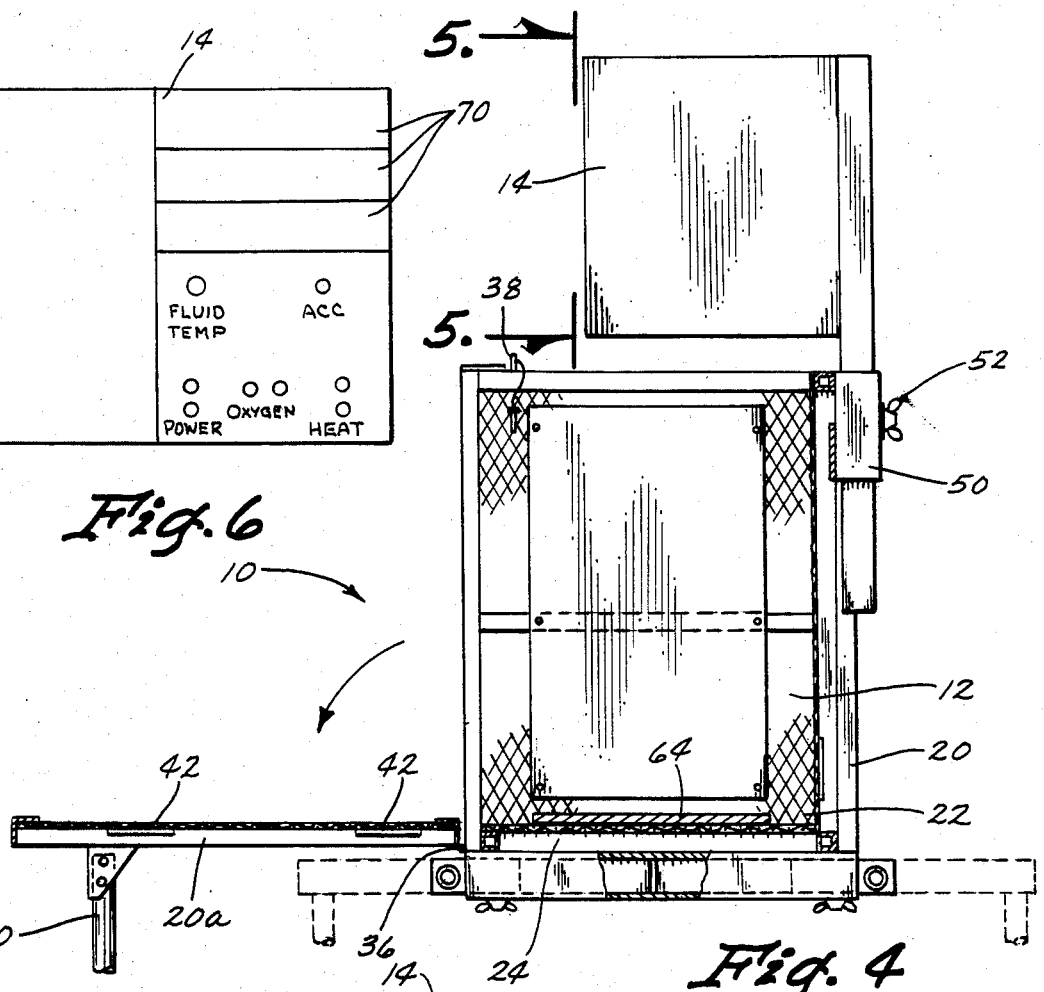
FIG. 4 is a cross-sectional view taken along lines 4—4 of FIG. 3.
Figure 5:
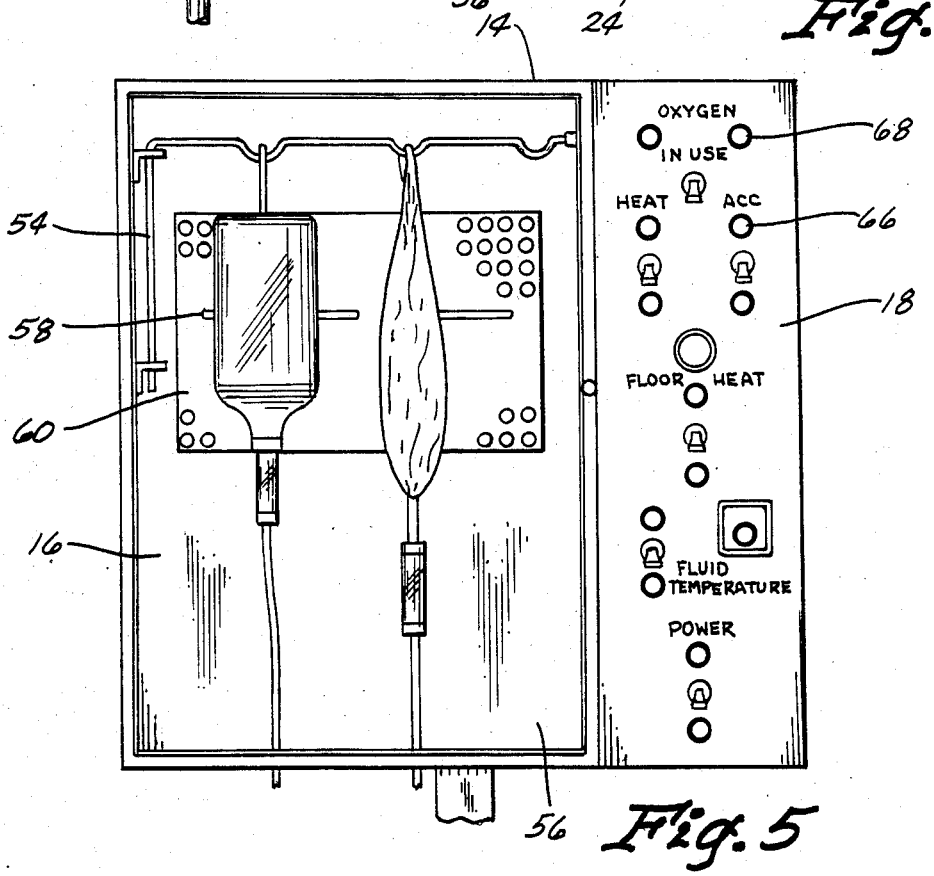
FIG. 5 is a front view of the control cabinet illustrating the use of intravenous fluids being held therein.

The control cabinet 14 in the preferred embodiment is positioned directly overhead the restraint unit 12 and is adjustable in height by a slideable frame 50 held in place by locking screw 52 (FIGS. 1, 3 and 4). The cabinet 14 is generally rectanguler in shape and constructed of non-corrosive material. The fluid/medication chamber 16 normally would be insulated to assist in maintaining a constant temperature therein and is adapted to store medication and fluids as well as hanging intravenous fluids through conventional means 54 during their use. The front of the chamber 16 is secured by a door 56 through which visual observation of the interior of the chamber 16 may be made without opening the door 56. The temperature of the interior of the chamber 16 is maintained at a predetermined level through a conventional electrical resistance heating element 58 which is behind a dispensing plate 60. The heating element 58 is connected to the control chamber 18 where the temperature is set. The intravenous fluid feeding line 62 passes through a aperture 64 in the bottom of the chamber 16 to gain access to the restraining unit 12. As illustrated in FIGS. 5 and 6, the control chamber 18 controls a heating pad 64 placed in the restraining unit 12 and electrically connected thereto, the heating element 58 in the chamber 16, and an accessory monitor 66 providing an additional source of electricity and a visual indicator 68 of oxygen in use. Further, as illustrated in FIG. 6, additional bodily function monitors may be added to the control chamber 18. Further, other monitoring and visual indicating equipment may be added to the control chamber 18 depending upon the specific needs. The control chamber 18 is connected to an external source of electrical energy which powers the intensive care unit 10.

As illustrated in FIGS. 1–3, external oxygen is available through an external pressurized container 72 attached to the restraining unit 12.

As is readily seen and understood, the mobile livestock intensive care unit 10 provides a compact, highly mobile, self-contained unit wherein the animal 74 may be confined as illustrated in FIG. 3 with controllable external heat added by heating pad 64 and medications/fluids maintained at a desired temperature and delivered to the animal 74 in a controlled environment. The unit's construction allows easy cleaning of the unit and general sanitizing.

While the invention has been described with a certain degree of particularity, it is manifested that many changes may be made within the details of the construction and the arrangement of components without departing from the spirit and scope of this disclosure. It is understood that the invention is not limited to the embodiment set forth herein for purposes of exemplification, but it is to be limited only by the scope of the attached claims or claims, including the full range of equivalency to which each element thereof it entitled.

I claim:

1. A portable livestock intensive care unit, comprising:

a restraining unit for housing an animal undergoing treatment having two vertical sidewalls and two vertical endwalls, the walls spaced at right angles to each other and engaging each other and a floor, said floor engaging the bottom portion of said walls, said restraining unit including means for restraining movement of an animal when placed inside of said housing;

a pair of wheels mounted below the floor and parallel to each other, said wheels positioned at one end of the unit and generally defining the front of the unit;

at least one leg extending downward from the floor of the end of the restraining unit opposite said wheels and generally defining the rear of the unit;

one of the said walls between the front and rear of the unit being rotatably attached to the floor and releaseably attached to one of said end walls, and opening outwardly from the unit to a semi-horizontal position;

a control cabinet mounted to the restraining unit adjacent thereto and including a fluid/medication chamber and a control chamber; said fluid/medication chamber including means adapted to receive fluids and medications for and during treatment of the animal; a controllable heating means in the fluid/medication chamber for maintaining the fluid/medication chamber at a predetermined temperature; said control chamber adapted to be connected to a source of electrical energy and electrically connected to the heating means for controlling the heating means and further including means adapted to control and monitor said heating means and also add other controls and monitors for other components that may be used with the unit.

2. A portable livestock intensive care unit as defined in claim 1 wherein the fluid/medication chamber is generally a rectangular shaped box and includes a hinged front door panel through which visual observation and entrance to the interior of the chamber may be obtained.

3. A portable livestock intensive care unit as defined in claim 1 further including controllable heating means electrically connected to the control chamber and for supplying heat to the restraining area.

4. A portable livestock intensive care unit as defined in claim 1 further including a source of oxygen for administration to the animal, said oxygen confined to a pressurized container and secured to the unit and further including an oxygen visual indicator on said control chamber for providing visual indication of oxygen in use.

5. A portable livestock intensive care unit as defined in claim 1 further including side legs, said legs being rotatably attached to the upper portion of the wall that is openable from the unit and rotate downward as the wall is opened to contact the ground.

6. A portable livestock intensive care unit as defined in claim 5 wherein said restraining means comprises the openable wall having animal restraint means for placing one or more ropes through the wall and around an animal to restrain movement of the animal.

7. A portable livestock intensive care unit as defined in claim 1 wherein the front end wall includes a door, said door being rotatably connected at its bottom to said wall and releaseably attached at the top to the unit to permit said door to move outward at its top to a horizontal position and held by restraining straps.

8. A portable livestock intensive care unit as defined in claim 1 wherein said controllable having means includes an electrical resistance heating element which generates heat when electricity flows therethrough.

* * * * *